US007465006B2

(12) United States Patent
Edamura et al.

(10) Patent No.: US 7,465,006 B2
(45) Date of Patent: Dec. 16, 2008

(54) INK JET PRINTING APPARATUS, INK JET PRINTING METHOD, AND PRELIMINARY DISCHARGE CONTROL METHOD

(75) Inventors: Tetsuya Edamura, Kawasaki (JP); Kiichiro Takahashi, Yokohama (JP); Minoru Teshigawara, Yokohama (JP); Akiko Maru, Kawasaki (JP); Yoshiaki Murayama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 209 days.

(21) Appl. No.: 11/477,459

(22) Filed: Jun. 30, 2006

(65) Prior Publication Data

US 2007/0008367 A1 Jan. 11, 2007

(30) Foreign Application Priority Data

Jul. 7, 2005 (JP) ..... 2005-198953

(51) Int. Cl.
*B41J 29/38* (2006.01)

(52) U.S. Cl. ..... 347/14; 347/19; 347/35

(58) Field of Classification Search ..... 347/14, 347/23, 35, 92, 19
See application file for complete search history.

(56) References Cited

U.S. PATENT DOCUMENTS

| | | | | |
|---|---|---|---|---|
| 5,659,342 | A * | 8/1997 | Lund et al. | 347/35 |
| 6,227,646 | B1 | 5/2001 | Yano et al. | |
| 6,390,577 | B1 * | 5/2002 | Fajour | 347/2 |
| 6,644,772 | B2 * | 11/2003 | Choi | 347/19 |
| 6,719,400 | B2 | 4/2004 | Inui et al. | |
| 6,984,009 | B2 | 1/2006 | Nakagawa et al. | |
| 7,011,386 | B2 | 3/2006 | Iwasaki et al. | |
| 7,029,092 | B2 | 4/2006 | Edamura et al. | |
| 7,207,649 | B2 | 4/2007 | Ide et al. | |
| 2005/0174382 | A1 | 8/2005 | Yoshikawa et al. | |
| 2005/0270313 | A1 | 12/2005 | Oshio et al. | |
| 2007/0008368 | A1 | 1/2007 | Maru et al. | |

FOREIGN PATENT DOCUMENTS

| | | |
|---|---|---|
| JP | 63-252748 | 10/1988 |
| JP | 2002-137371 | 5/2002 |
| JP | 2003-127353 | 5/2003 |
| JP | 2004-1416 | 1/2004 |
| JP | 2004-82629 | 3/2004 |

* cited by examiner

*Primary Examiner*—Thinh H Nguyen
(74) *Attorney, Agent, or Firm*—Fitzpatrick, Cella, Harper & Scinto

(57) ABSTRACT

On performing a predetermined printing operation, whether or not, among a plurality of printing elements, only a part of the printing elements are applied is detected. If it is judged that only the part of the printing elements are used, a judgment is made whether or not the preliminary discharge operation is performed based on the number of discharges for the part of the printing elements, and if it is not judged that only the part of the printing elements are used, a judgment is made whether or not the preliminary discharge operation is performed based on the number of discharges for all of the printing elements of the printing head. This eliminates an unnecessary preliminary discharge for non-printing elements even in a printing operation mode in which only a part of the printing elements are applied.

9 Claims, 8 Drawing Sheets

INK JET PRINTING APPARATUS, INK JET PRINTING METHOD, AND PRELIMINARY DISCHARGE CONTROL METHOD

BACKGROUND OF THE INVENTION

1. Field of the Invention

The present invention relates to an ink jet printing apparatus and a method of controlling preliminary discharge of the apparatus.

2. Description of the Related Art

An ink jet printing head discharges an ink droplet within a nozzle from a minute hole (hereinafter referred to as a discharge port) of the nozzle toward a printing medium to perform printing. As the printing head discharges the ink, the ink within the nozzle is decreased and a new ink is charged from an ink chamber by capillary force.

However, when the ink is not discharged over a long period of time, evaporation of moisture and a solvent of the ink may cause a color material to be precipitated at the discharge port and the precipitated color material may form a film at the discharge port, thus preventing a normal ink discharge. A kinetic energy produced to discharge the ink droplet by a printing operation of the printing head is consumed in breaking the film. As a result, the ink droplet cannot achieve a sufficient discharge speed and thus cannot be printed in a desired position on the printing medium.

To cope with this, the ink jet printing apparatus performs a preliminary discharge operation to move the printing head outside the printing medium and to discharge the ink at a predetermined location before a complete film is formed at the discharge port. By performing the preliminary discharge operation, the nozzle can be maintained in a condition to do a normal ink discharge during printing.

In general, a serial-scanning ink jet printing apparatus judges whether or not a predetermined time has passed since a previous preliminary discharge at the time of an inversion during reciprocating scanning of a carriage with a printing head, and performs such control as to move the printing head outside a printing medium for a preliminary discharge if the predetermined time has passed.

However, frequent preliminary discharge operations cause printing speed to be decreased, and also involve the disadvantage that consumption of the ink except in actual printing leads to a rise in running costs.

In order to eliminate such disadvantage, for example, Japanese Patent Application Laid-open No. 63-252748 discloses a control method, wherein the number of actuations of a plurality of nozzles is measured in a predetermined time, and if the value measured is less than a predetermined number, a preliminary discharge is performed, while if the value measured is equal to or greater than the predetermined number, the preliminary discharge is not performed. This method eliminates the preliminary discharge operation of nozzles undergoing frequent discharge operations, and therefore the time and amount of ink wasted in the preliminary discharge are reduced.

Also, Japanese Patent Application Laid-open No. 2004-082629 discloses a method, wherein the number of actuations of a plurality of nozzles is measured in a predetermined time, a judgment is made whether the value measured is equal to or greater than a predetermined number, and based on the judgment, a subsequent printable time is adjusted. And with each completion of a printing scanning, the adjusted printable time is compared with the time required for subsequent printing scanning, and a preliminary discharge operation is performed if the printable time is shorter. A control method like this does not perform the preliminary discharge carelessly with each printing scanning even when the time required for one printing scanning is equivalent to discharge-guarantee time of non-discharge nozzles. This enables the preliminary discharge to be efficiently performed without reducing throughput as much as possible.

The preliminary discharge of the ink jet printing apparatus is an important operation required to maintain image quality. On the other hand, however, the preliminary discharge can trigger an increased ink consumption and decreased throughput. Based on this standpoint, one of the problems in recent ink jet printing apparatuses is how efficiently and unwastedly the preliminary discharge operation is performed.

In recent years, there has been an increasing demand for so-called "margin-less printing" in which an image is formed on a printing medium without setting in any margin. And a number of arrangements or printing methods which enable such printing have already been proposed (refer to Japanese Patent Application Laid-open No. 2003-127353 and No. 2004-1416). When, in the "margin-less printing", printing is performed in the vicinity of an endmost portion of the printing medium, support of the printing medium becomes unstable, which may cause conveyance accuracy of the printing medium to be decreased. Also, there are concerns that ink discharged running off the printing medium may contaminate an inside of the apparatus or of a non-printed area of the printing medium. Therefore, as disclosed in the above-mentioned publication, No. 2004-1416, for printing in the vicinity of the endmost portion of the printing medium, a method is generally adopted in which the number of nozzles to be practically applied to the printing is limited.

Even when such "margin-less printing" is performed, the preliminary discharge method described in either of the above-mentioned publications, No. 63-252748 or No. 2004-082629, has been conventionally adopted. However, with a limited number of nozzles for printing on the endmost portion, non-discharge nozzles which are not involved in printing always exist, and therefore the conventional preliminary discharge control methods are not able to bring about an efficient preliminary discharge operation. That is, during printing in the vicinity of the endmost portion of the printing medium, due to the nozzles which are not involved in the printing, more preliminary discharge operations than required are performed, and accordingly the ink is improperly consumed, resulting in a decreased throughput.

SUMMARY OF THE INVENTION

The present invention has been made in view of the foregoing problem and therefore has an object to provide an ink jet printing apparatus and a preliminary discharge control method which are capable of performing a more efficient preliminary discharge operation in terms of ink consumption and throughput even when the number of nozzles to be used is limited for image formation as in the "margin-less printing".

The first aspect of the present invention is an ink jet printing apparatus for printing an-image on a printing medium using a printing head having a plurality of printing elements to discharge ink, comprising: means for counting the number of discharges by the printing elements of the printing head; means for judging whether or not a preliminary discharge operation of the printing head is necessary, based on the number of discharges obtained by the counting means; and means for performing the preliminary discharge by the printing elements of the printing head in accordance with a result of the judgment by the judging means, wherein when a printing operation is performed using only a part of the printing elements among the plurality of the printing elements of the printing head, the judging means judges whether or not the preliminary discharge operation is necessary based on the number of discharges counted for the part of the printing elements.

The second aspect of the present invention is an ink jet printing apparatus for printing an image on a printing medium using a printing head having a plurality of printing elements to discharge ink, comprising: print control means for performing a first printing operation in which printing is performed on a central part of the printing medium using the plurality of the printing elements and a second printing operation in which printing is performed on front and rear portions of the printing medium using a part of the printing elements smaller in number than the plurality of printing elements; means for counting the number of discharges by the printing elements of the printing head; means for judging whether or not a preliminary discharge operation of the printing head is necessary, based on the number of discharges obtained by the counting means; and means for performing the preliminary discharge by the printing elements of the printing head in accordance with a result of the judgment by the judging means, wherein the judging means, when the second printing operation is performed, judges whether or not the preliminary discharge operation is necessary based on the number of discharges counted for the part of the printing elements, and when the first printing operation is performed, judges whether or not the preliminary discharge operation is necessary based on the number of discharges counted for the plurality of the printing elements.

The third aspect of the present invention is an ink jet printing apparatus for printing an image on a printing medium using a printing head including a plurality of printing elements to discharge ink, comprising: means for detecting whether or not only a part of the printing elements among the plurality of the printing elements are used for a printing operation; means for counting the number of discharges by the printing elements for the printing operation; means for judging whether or not a preliminary discharge operation of the printing head is necessary based on the number of discharges obtained by the counting means; and means for performing the preliminary discharge by the printing elements of the printing head in accordance with a result of the judgment by the judging means, wherein the judging means, if the detecting means detects that only the part of the printing elements are used, judges whether or not the preliminary discharge operation is necessary based on the number of discharges for the part of the printing elements, and if the detecting means does not detect that only the part of the printing elements are used, judges whether or not the preliminary discharge operation is necessary based on the number of discharges for all of the printing elements of the printing head.

The forth aspect of the present invention is an ink jet printing method for printing an image on a printing medium using a printing head including a plurality of printing elements to discharge ink, comprising the steps of: counting the number of discharges by the printing elements of the printing head; judging whether or not a preliminary discharge operation of the printing head is necessary, based on the number of discharges obtained by the counting step; and performing the preliminary discharge by the printing elements of the printing head in accordance with a result of the judgment, wherein, when a printing operation is performed using only a part of the printing elements among the plurality of printing elements of the printing head, in the judging step, whether or not the preliminary discharge operation is necessary is judged based on the number of discharges counted for the part of the printing elements.

The fifth aspect of the present invention is an ink jet printing method for printing an image on a printing medium using a printing head having a plurality of printing elements to discharge ink, comprising: a first printing step of performing printing on a central part of the printing medium using the plurality of the printing elements ; a second printing step of performing printing on front and rear portions of the printing medium using a part of the printing elements smaller in number than the plurality of printing elements; a counting step of counting the number of discharges by the printing elements of the printing head; a judging step of judging whether or not a preliminary discharge operation of the printing head is necessary, based on the number of discharges obtained by the counting step; and a step of performing the preliminary discharge by the printing elements of the printing head in accordance with a result of the judgment, wherein, for the second printing step, whether or not the preliminary discharge operation is necessary is judged based on the number of discharges counted for the part of the printing elements in the judging step, and for the first printing step, whether or not the preliminary discharge operation is necessary is judged based on the number of discharges counted for the plurality of the printing elements in the judging step.

The sixth aspect of the present invention is a preliminary discharge control method for an ink jet printing apparatus for printing an image on a printing medium using a printing head having a plurality of printing elements to discharge ink, comprising the steps of: detecting whether or not only a part of the printing elements among the plurality of printing elements are used for a printing operation ; counting the number of discharges from each of the printing elements for the printing operation; judging whether or not a preliminary discharge operation of the printing head is necessary based on the number of discharges obtained by the counting step; and performing the preliminary discharge by the printing elements of the printing head in accordance with a result of the judgment by the judging step, wherein if it is detected that only the part of the printing elements are used in the detecting step, whether or not the preliminary discharge operation is necessary is judged based on the number of the discharges for the part of the printing elements in the judging step, and if it is not detected that only the part of the printing elements are used in the detecting step, whether or not the preliminary discharge operation is necessary is judged based on the number of discharges for all of the printing elements of the printing head in the judging step.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

Preferred embodiments of the present invention will hereinafter be described in detail with reference to the accompany drawings. A term "printing" as used herein refers not only to formation of significant information such as characters and graphics but also broadly to formation of images, figures, patterns, and the like on a printing medium, or processing of the medium, regardless of whether they are significant or insignificant and whether or not they are embodied so as to be visually perceived by human beings. Also, a term "printing medium" refers not only to paper for use in common printing apparatus but also broadly to ink-acceptable materials such as cloth, a plastic film, a metal sheet, glass, ceramics, wood, and leather. Further, a term "ink" is broadly interpreted as in the definition of the "printing" described above, and refers to a liquid which, when applied to the printing medium, can form images, figures, patterns, and the like, can process the printing medium, or can process the ink (for example, solidify or insolubilize a coloring material in the ink applied to the printing medium). Furthermore, a term "nozzle" refers generally to a discharge port to a fluid channel communicating therewith and an element which produces energy to be utilized for ink discharge unless otherwise noted.

Additionally, a term "margin-less printing" as used herein means printing on at least one of front and rear edges of the printing medium without setting any margin. The margin-less printing generally requires that the size of a printing area be greater than that of the printing medium, but it is acceptable that the size of the printing area corresponds to that of the printing medium.

<Description of the Ink Jet Printing Apparatus>

Figure 1:
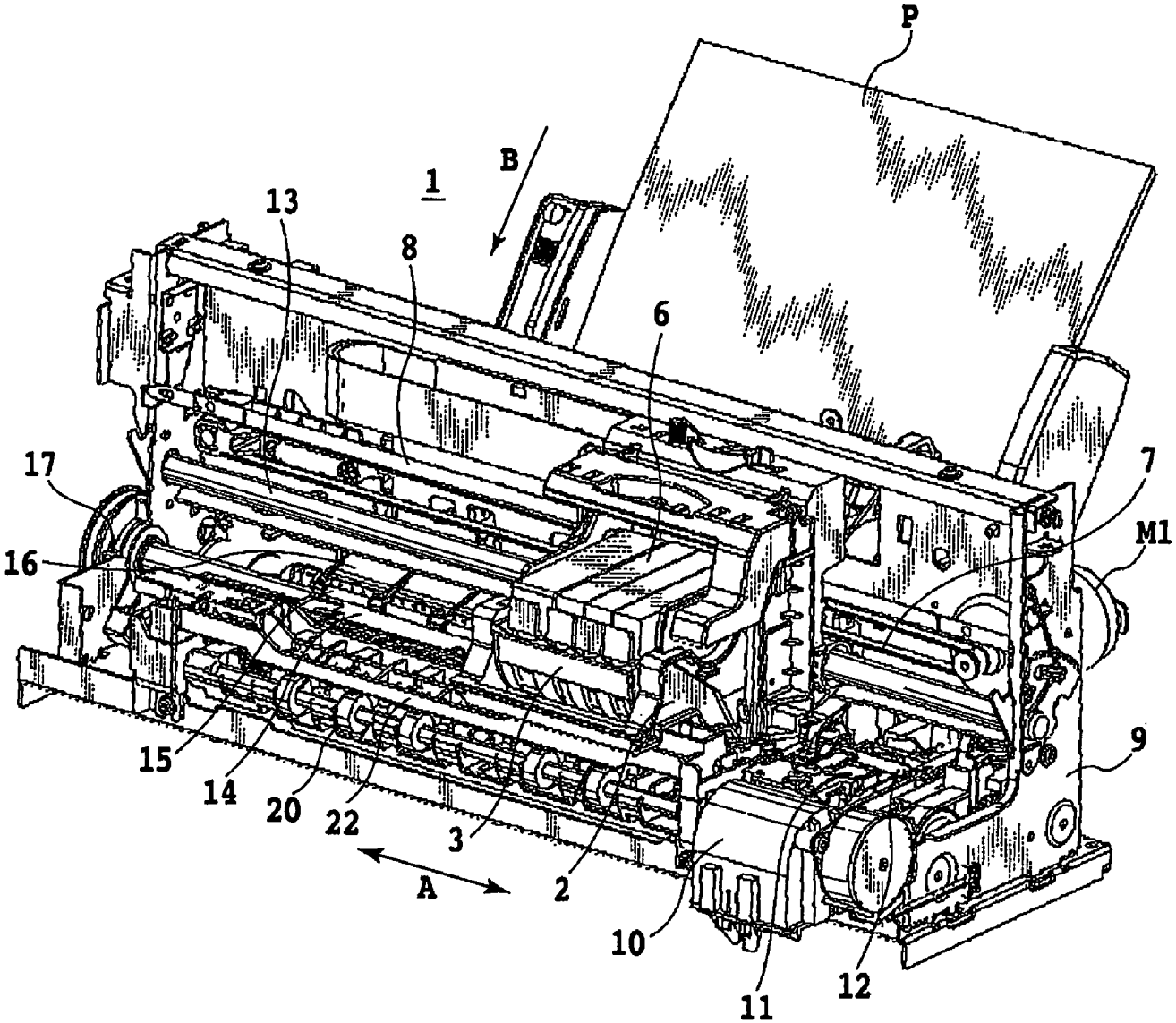
FIG. 1 is an external perspective view showing an outline of a construction of an ink jet printing apparatus as a typical embodiment of the present invention.

FIG. 1 is an external perspective view showing an outline of a construction of an ink jet printing apparatus 1 as a typical embodiment of the present invention. Referring to the figure, there is shown a carriage 2 capable of moving in the direction of arrow A shown with a printing head cartridge 3 mounted. The printing head cartridge 3 is equipped with a printing head to discharge ink in accordance with an image signal and a removable ink tank 6 to supply the ink to this printing head. The printing apparatus 1 in the present embodiment allows for color printing and the printing head cartridge 3 is equipped with four ink tanks 6 containing magenta (M), cyan (C), yellow (Y), and black (Bk) inks, respectively. These four ink tanks 6 are independently removably attached to the printing head cartridge 3. Each of the color inks contained in the ink tanks 6 is supplied to the printing head with a discharge operation.

Figure 2:
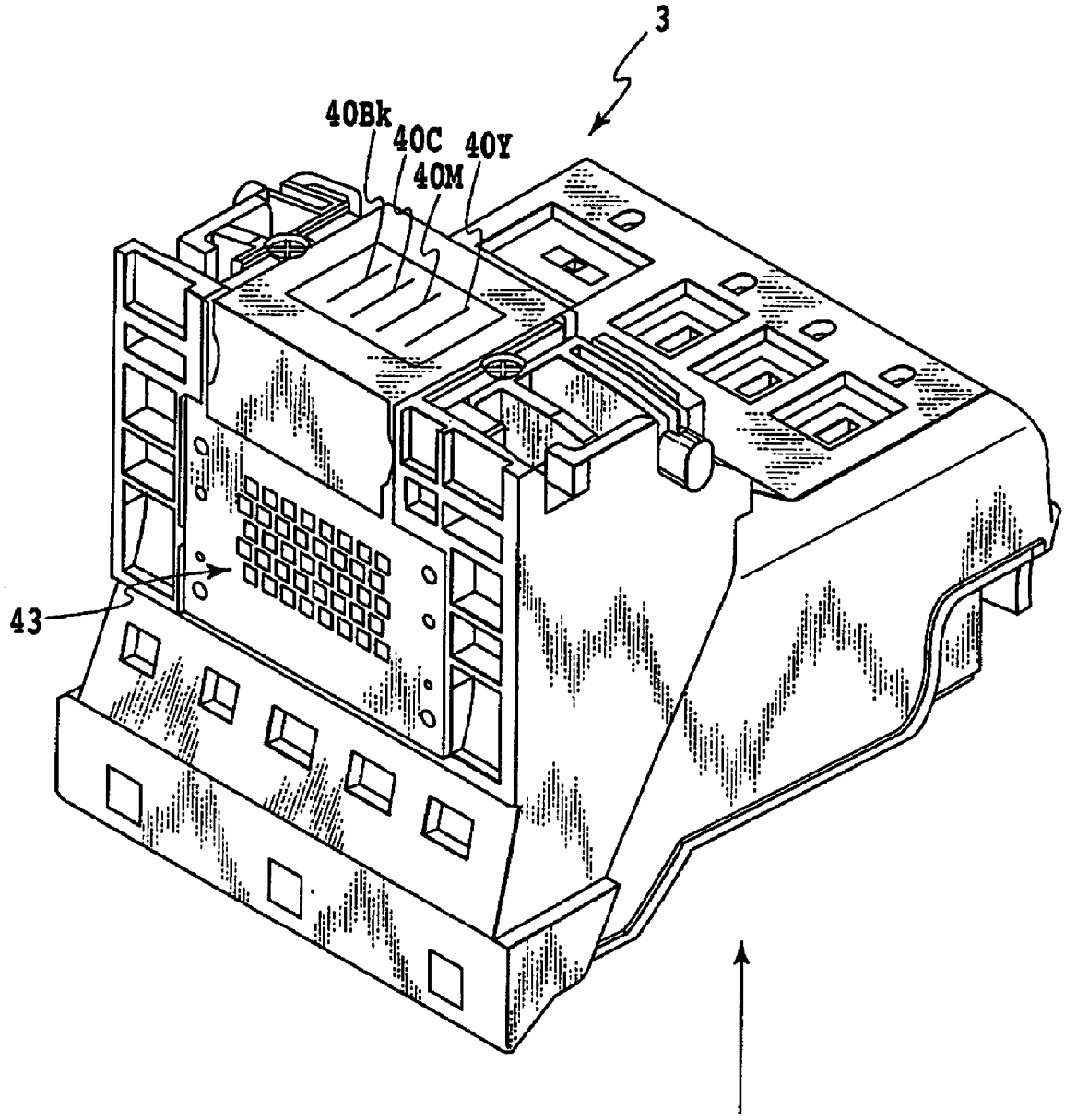
FIG. 2 is a detail drawing (a perspective view) of a printing head cartridge used in the embodiment of the present invention as viewed from a discharge port side.

FIG. 2 is a detail drawing (a perspective view) of the printing head cartridge 3 used in the present embodiment as viewed from a discharge port side. The printing head cartridge 3 is shown inverted compared with a normal service condition. Discharge port arrays 40Bk, 40C, 40M, and 40Y are designed to discharge four color inks, Bk (black), C (cyan), M (magenta), and Y (yellow), respectively. The ink tank 6 of each color is configured to be attached from the direction of an arrow in the figure.

The printing head in the present embodiment adopts an ink jet system in which thermal energy is used to discharge the ink and has an electrothermal converter to produce thermal energy within each individual nozzle. For printing (discharge), according to image signals, electrical energy is applied to each individual electrothermal converter, where it is converted into thermal energy. Due to rapid heat generation, film boiling takes place in the ink near the electrothermal converter, and by growth and contraction of bubbles, a given amount of ink is discharged from the discharge port.

The printing head cartridge 3 has a contact surface 43 to establish and maintain an electrical connection with the carriage 2. Depending on printing signals received from the contact surface 43, the printing head 3 can selectively discharge the ink from a plurality of nozzles (discharge ports).

Referring again to FIG. 1, the carriage 2 is coupled to a part of a drive belt 7 of a transmission mechanism to transmit a driving force of a carriage motor M1, and is slidably guided and supported along a guide shaft 13 in the direction of arrow A. Therefore, the carriage 2 is arranged to be able to reciprocate along the guide shaft 13 through normal and reverse rotations of the carriage motor M1.

Along the moving direction (the direction of arrow A) of the carriage 2, a scale 8 to indicate an absolute position of the carriage 2 is provided. The scale 8 in the present embodiment is made of a transparent PET film on which a black bar is printed at a predetermined pitch. One end of the scale 8 is fixed to a chassis 9 and the other is supported by a blade spring (not shown).

With the arrangement described above, while the carriage 2 is doing scanning, the printing head 3 can discharge the ink at an appropriate timing according to the positional information. This allows an image corresponding to one printing scanning to be formed on the printing medium P. In a position opposite to the printing head 3, a platen (not shown in FIG. 1) is disposed in such a manner as to support the printing medium P from the underside thereof. The printing apparatus 1 in the present embodiment is a printing apparatus capable of "margin-less printing". For that purpose the platen is made to have a special feature, but the details of the platen will be described later.

When one printing scanning is performed, the printing medium P is conveyed in the direction of arrow B by a conveying mechanism to be described below. A conveyor motor M2 (not shown in FIG. 1) functions as a driving force of the conveying mechanism and a conveying roller 14 makes contact with the printing medium P to convey it. A driving force of the conveyor motor M2 is transmitted to the conveying roller 14 through an intermediate gear (not shown) and a conveying roller gear 17 fixed to one end of the conveying roller 14. The printing medium P is brought into contact with the conveying roller 14 by a pinch roller 15 urged by a spring (not shown) and is conveyed in the direction of arrow B with rotation of the conveying roller 14. In addition, the pinch roller 15 is rotatably supported by a pinch roller holder 16.

A discharging roller 20 discharges the printing medium P on which an image is formed outside the printing apparatus. The discharging roller 20 is also rotated by the driving force transmitted from the conveyor motor M2. The printing medium P is brought into contact with the discharging roller 20 by a spur roller urged by a spring (not shown). The spur roller is rotatably supported by a spur roller holder 22. The printing medium P is conveyed in the direction of arrow B, being clipped by two pairs of rollers, i.e., a roller pair consisting of the conveying roller 14 and the pinch roller 15, and a roller pair consisting of the discharging roller 20 and the spur roller. However, the printing medium is clipped and conveyed only by either roller pair while printing is performed on a front or rear edge of the printing medium in the "margin-less printing".

With the arrangement described above, intermittent repetition of main printing scanning by the printing head cartridge 3 and a given amount of conveying operation allows an image to be formed one after another on the printing medium P.

In a position (for example, a position corresponding to a home position) outside a printing scanning area of the carriage 2, a recovery device to make the printing head recover from a discharge failure is disposed. The recovery device includes a capping mechanism 11 to cap the discharge port surface of the printing head, and a wiping mechanism 12 and a suction member 10 to clean the discharge port surface of the printing head. With the discharge port surface capped with the capping mechanism 11, the suction member 10 forcibly discharges the ink from the discharge port, and thereby viscosity-increased ink, bubbles or the like existing within an ink flow channel in the nozzle can be removed. Also, when no printing operation is performed, the discharge port surface of the printing head is capped with the capping mechanism 11, and thereby the printing head can be protected and the ink can be prevented from evaporating from the discharge port and from drying.

On the other hand, the wiping mechanism 12 is arranged in the vicinity of the capping mechanism 11 to serve to wipe an ink droplet or the like off the discharge port surface of the printing head. The recovery device comprising the capping mechanism 11, the wiping mechanism 12, and the suction member 10 enables the ink discharge condition of the printing head to be normally maintained.

<Control Architecture of the Ink Jet Printing Apparatus>

Figure 3:
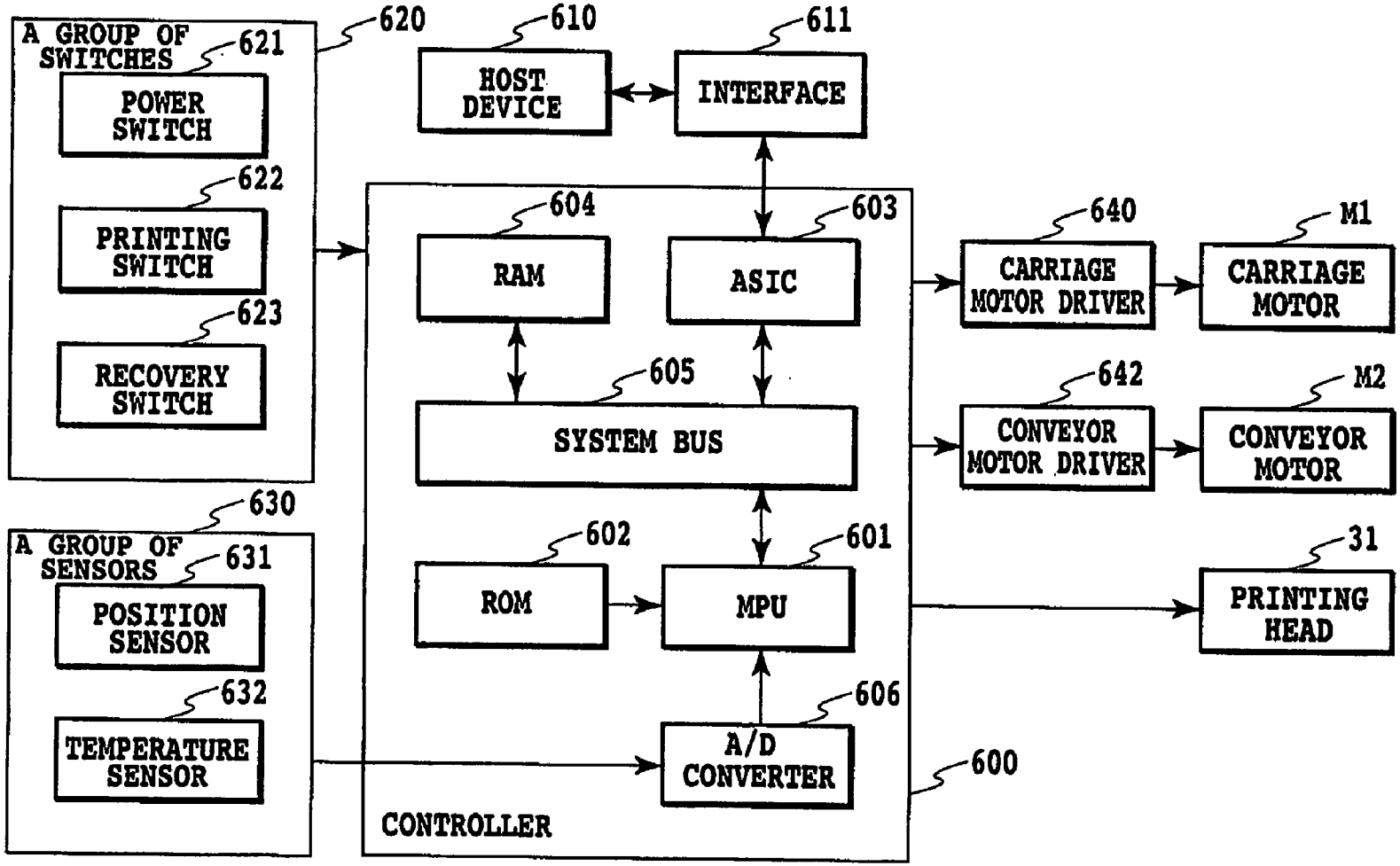
FIG. 3 is a block diagram showing a control configuration of a printing apparatus applied in the embodiment of the present invention.

FIG. 3 is a block diagram showing a control configuration of the printing apparatus applied in the present embodiment. Referring to the figure, there is shown a controller 600 which governs control of the entire printing apparatus. The controller 600 is provided with an MPU 601, a ROM 602, an ASIC 603, a RAM 604, a system bus 605, an A/D converter 606, and the like.

The ROM 602 stores programs corresponding to a control sequence to be executed by the MPU 601, required tables, other fixed data, and the like. The ASIC 603 serves to generate control signals to control the carriage motor M1, the conveyor motor M2, and a printing head 31. The RAM 604 is utilized as an area for decompression of image data or as a working area for program execution. The system bus 605 interconnects the MPU 601, the ASIC 603, and the RAM 604 to transmit and receive data among them. And, the A/D converter 606 inputs and A/D-converts analog signals from a group of sensors 630 and sends digital signals to the MPU 601.

A host device 610, being externally connected, is connected through an interface 611 to the printing apparatus in the present embodiment. The host device 610 may be of any form if it serves as a source of supply of image data to the printing apparatus, and a computer, a reader for image scanning, a digital camera or the like is applicable. The interface 611 is capable of sending and receiving a variety of commands and status signals or the like of the printing apparatus in addition to the image data.

A group of switches 620 comprises switches to receive command inputs from an operator, such as a power switch 621, a printing switch 622 to give a command to start printing, and a recovery switch 623 to give a direction to initiate a recovery operation. A group of sensors 630 to detect a status of the apparatus comprises a position sensor 631 such as a photo-coupler to detect the home position and a temperature sensor 632 to detect environmental temperature.

Further, there are shown a carriage motor driver 640 to drive the carriage motor M1 and a conveyor motor driver 642 to drive the conveyor motor M2.

When a printing command is inputted from the host device 610, the printing apparatus body analyzes the command and decompresses image data to a decompression buffer in the RAM 604. The decompressed image data is subjected to a given processing and then stored in a printing buffer in the RAM 604. For printing scanning, the ASIC 603 transmits drive data to the printing head 31 while having a direct access to the printing buffer in the RAM 604.

Next, a printing method used when "margin-less printing" is performed in the apparatus in the present embodiment will be described.

Figure 4A:
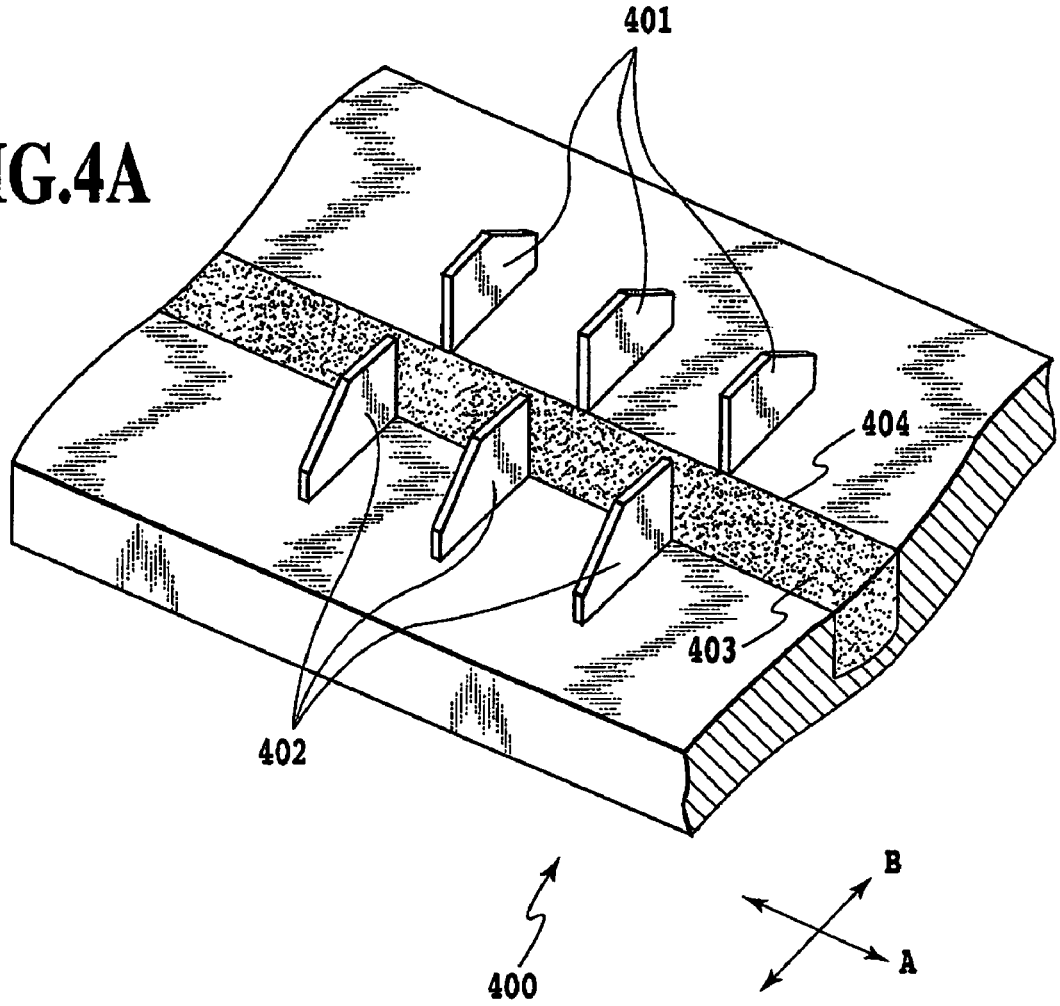
FIGS. 4A and 4B are enlarged views of a platen provided in the printing apparatus in the embodiment of the present invention.
Figure 4B:
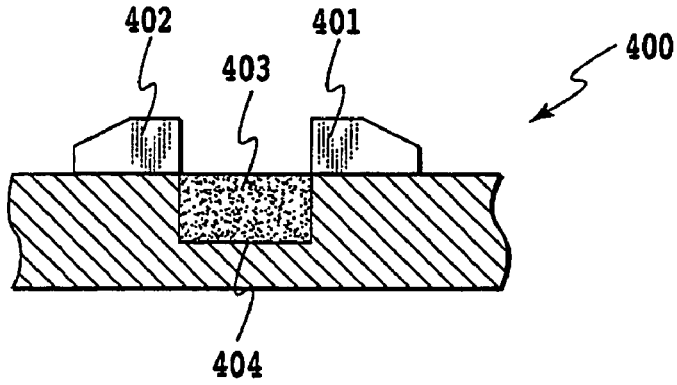

FIGS. 4A and 4B are enlarged views of a platen 400 provided in the printing apparatus in the present embodiment. FIG. 4A is a perspective view and FIG. 4B is a cross-sectional view. The platen 400 has upwardly projecting ribs 401 and 402. Thus, the printing medium P passing across the platen 400 is conveyed in the direction of B (sub-scanning direction) while being supported by top faces of the ribs 401 and 402. Disposed between the ribs 401 and 402 is a groove 404 with an ink absorber 403 therein, which receives ink that has run off the printing medium during "margin-less printing". It should, however, be noted that providing the groove 404 with the ink absorber 403 is not essential for the margin-less printing.

Figure 5A:
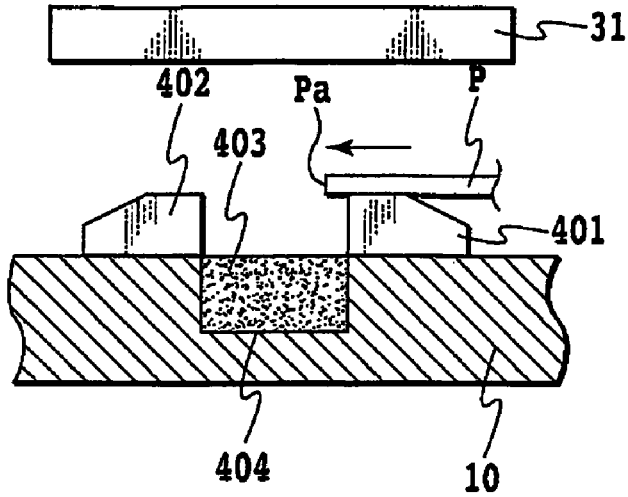
FIGS. 5A to 5C are schematic views illustrating a positional relationship between a printing medium and a printing head in the vicinity of the platen when "margin-less printing" is performed.
Figure 5B:
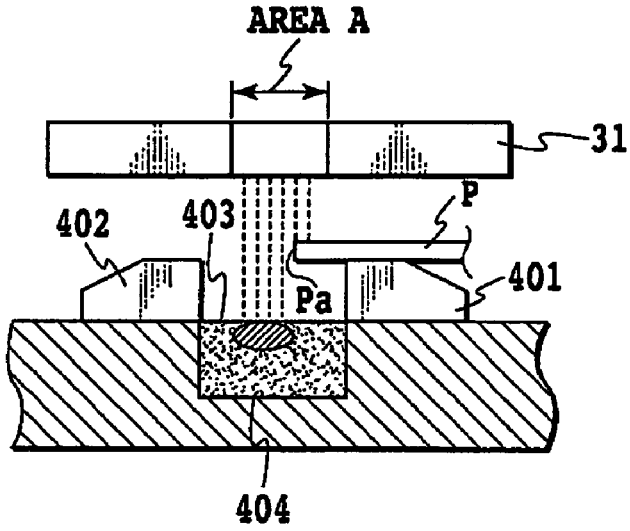
Figure 5C:
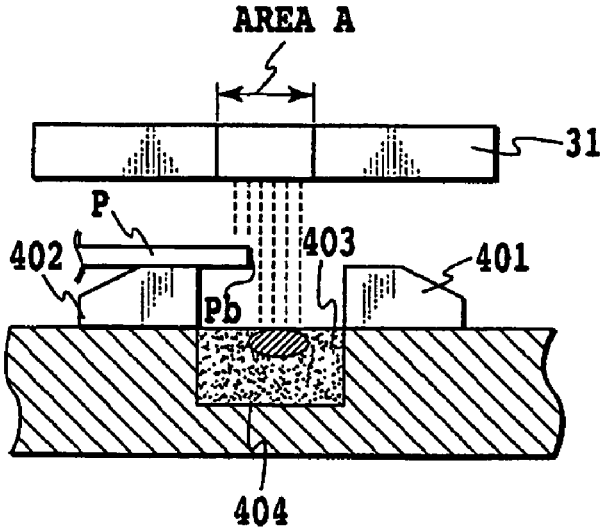

FIGS. 5A to 5C are schematic views illustrating a positional relationship between the printing medium P and the printing head 31 in the vicinity of the platen 400 when "margin-less printing" is performed.

On starting printing, in order to first perform the printing on a front edge Pa, the printing medium P is conveyed to a position where the front edge Pa is disposed between the ribs 401 and 402. This state is shown in FIG. 5A. When a positioning operation of the printing medium P is completed, the printing head 31 performs scanning in a main scanning direction and discharges ink droplets onto the front edge Pa (refer to FIG. 5B). At this moment, nozzles that actually perform a discharge operation are a part of the nozzles arranged in the printing head 31.

Figure 6:
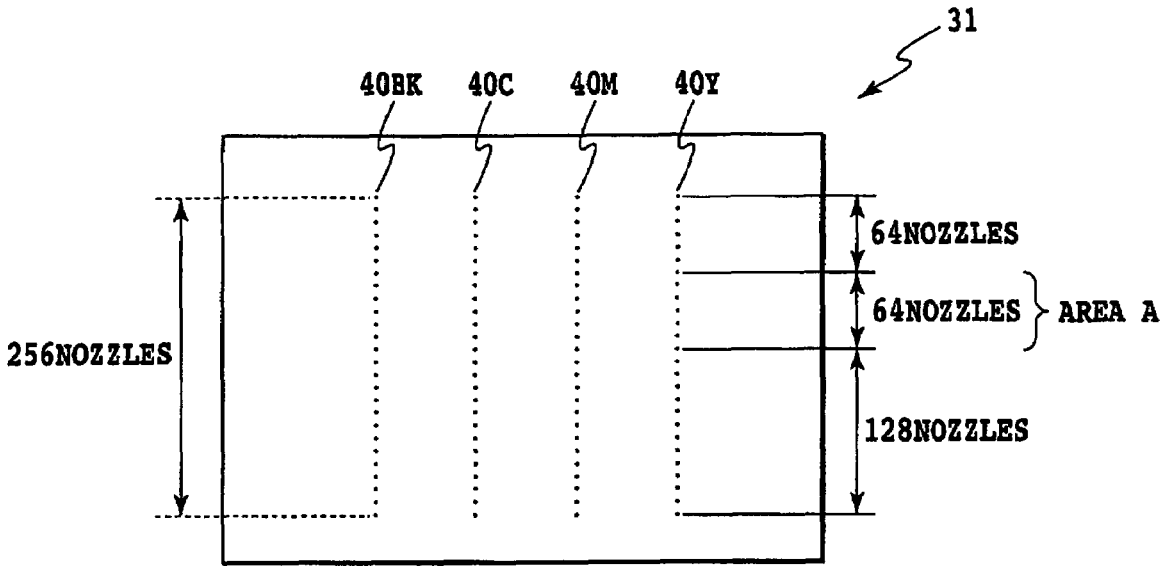
FIG. 6 is a schematic view illustrating an arrangement of discharge ports of a printing head applied in the embodiment of the present invention and an area of discharge ports that practically perform a discharge operation when printing is performed on front and rear edges in the "margin-less printing"

FIG. 6 is a schematic view illustrating an arrangement of discharge ports of the printing head 31 applied in the present embodiment and an area of discharge ports that practically perform a discharge operation when printing is performed on the front and rear edges in "margin-less printing". As already described in FIG. 1, the printing head 31 in the present embodiment includes the nozzle array 40Bk for black, nozzle array 40C for cyan, nozzle array 40M for magenta, and nozzle array 40Y for yellow, and in each nozzle array, 256 nozzles are arranged at a predetermined pitch in the sub-scanning direction (direction B).

When the printing apparatus is in a normal printing mode, not "margin-less printing" and when, even in the "margin-less printing" mode, an image is printed in an area other than the front and rear edges, all of the 256 nozzles of each color are used for discharging. However, when the printing is performed on the front or rear edge in the "margin-less printing", only 64 nozzles included in area A are used to form the image.

Image data to be printed on the endmost portion of the printing medium is created, extending off the front edge Pa to the outside. The purpose of this is to ensure formation of an image with no margin even if there are slight variations in conveyance accuracy and discharging direction of the printing apparatus. To this end, a portion facing area A of the printing head 31 is preliminarily provided with the absorber 403. Therefore, the ink discharged running off the endmost portion of the printing medium can be almost completely received by the absorber 403. The arrangement like this applies to right and left edges of the printing medium.

When one-line printing scanning is completed, the printing medium P is conveyed by the conveying roller 14 and a next printing scanning is performed. The next printing scanning is also provided to a printing for which only the 64 nozzles included in area A are used. Such main printing scanning and conveying operation are repeated, and when no ink comes to run off the front edge Pa even if the discharge is performed by all of the nozzles of the printing head 31, the range of the nozzles allowed to perform the discharge on the printing head 31 is expanded to the whole area. Thereafter, the printing scanning by all of the 256 nozzles and the conveying operation corresponding to a printing width of this printing scanning are repeated until printing in the vicinity of the rear edge Pb of the printing medium P.

FIG. 5C shows a state in which printing is performed in the vicinity of the rear edge Pb. Also in this state, the 64 nozzles included in area A are used to discharge the ink, running off the rear edge Pb to the outside. As is the case with the front edge, the ink discharged running off is almost completely received by the absorber 403.

As in the present embodiment, any arrangement in which the printing medium P is moved while being supported by the top faces of the ribs 401 and 402 formed in a position projecting beyond the absorber 403 and the platen plane prevents the printing medium P from making contact with the absorber 403 and the back side thereof from being contaminated.

<Preliminary Discharge Operation>

Hereinafter, a preliminary discharge sequence during printing in the present embodiment will be described.

Figure 7:
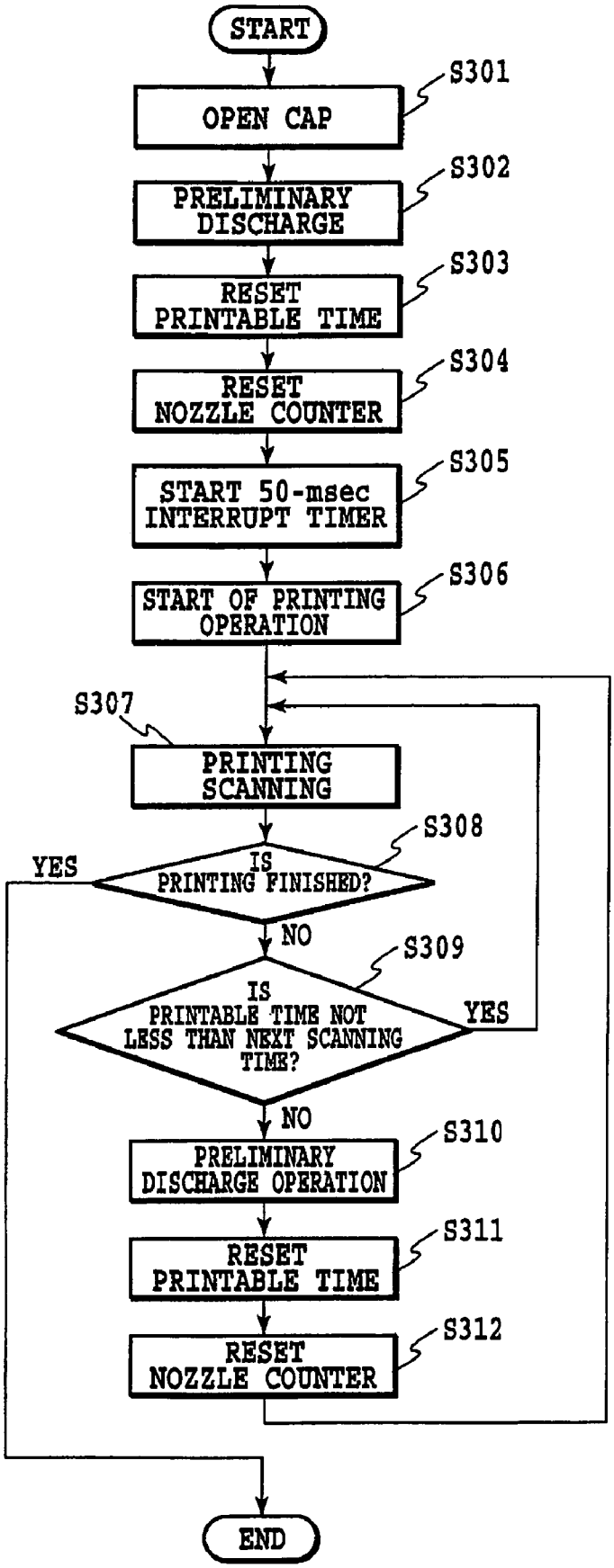
FIG. 7 is a flow chart illustrating a preliminary discharge control processing.

FIG. 7 is a flow chart illustrating a preliminary discharge control processing. This processing is carried out by the MPU 601 reading and executing a control program stored in the ROM 602.

While the printing apparatus is waiting for printing data, i.e., no printing operation is being performed, the discharge port surface of the printing head 31 is capped in the home position. When reception of a printing command from the host device 610 is confirmed, the MPU 601 operates the capping mechanism 11 to open the discharge port surface of the printing head 31 (step S301). And in a subsequent step S302, a preliminary discharge from all of the nozzles toward the capping mechanism 11 is performed.

Next, in step S303, a printable time (PENBL) is initialized to a predetermined value. The printable time (PENBL) is defined as a time for which the printing head is expected to normally perform a subsequent discharge even in a state where the discharge is not being performed. An initial value of PENBL is determined in accordance with performance of the printing head and the printing apparatus.

In step S304, a measured value (Dcount(i); i=1 to N, where N is a total number of nozzles) of a nozzle counter which measures the number of discharge actuations for each nozzle of the printing head 31 is initialized to "0".

The process then goes to step S305 to start an interrupt timer to create timing for updating the printable time (PENBL) at predetermined time intervals. In the present embodiment, an interrupt time interval (TINRT) is 50 msec. Interrupt processing in the present embodiment will be briefly described below.

Figure 8:
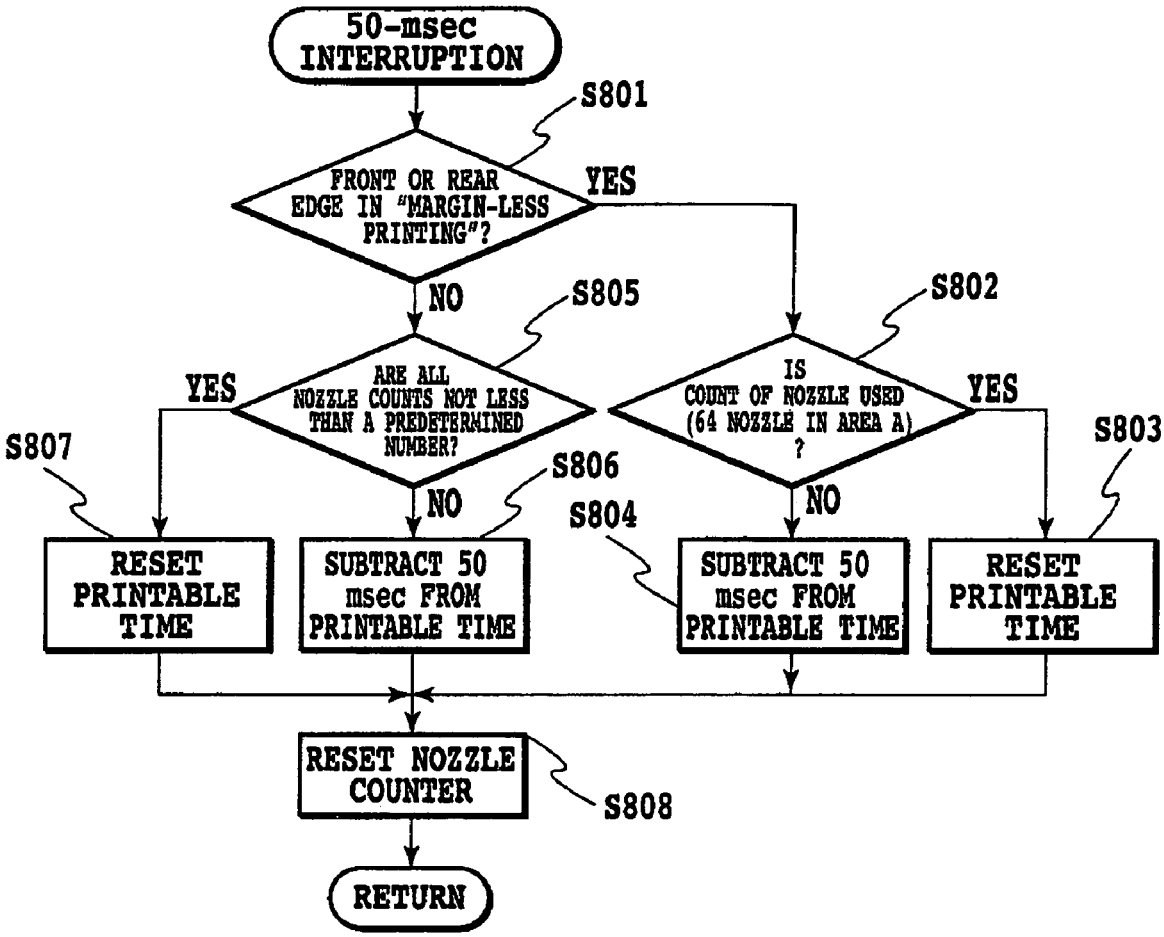
FIG. 8 is a flow chart illustrating an interrupt processing by an interrupt timer.

FIG. 8 is a flow chart illustrating the interrupt processing by the interrupt timer. First, in step S801, a judgment is made whether or not a next printing scanning is to be provided to the front or rear edge in the "margin-less printing". A method of the judgment may be a known one. For example, when printing is performed on the front or rear edge in the "margin-less printing", a predetermined memory within the printing apparatus is set to "1"; otherwise it is set to "0". And the memory value is referenced for judgment. If, in step S801, it is judged that the next printing scanning is not provided to the front or rear edge in the "margin-less printing", the process goes to step S805.

In step S805, a check is made to see if measured values (Dcount(i)=1, N) of nozzle counters of all the nozzles for all the colors reach a predetermined threshold value (TH). In the present embodiment, TH is set to 3. If all of the measured values of the nozzle counters satisfy Dcount≧3, the process goes to step S807 to reset the printable time (PENBL) for initialization. On the other hand, if the measured value of any one of the nozzle counters satisfies Dcount<3, the process goes to step S806 to subtract 50 msec from the printable time (PENBL) to update the printable time (PENBL).

If, in step S801, it is judged that the next printing scanning is provided to the front or rear edge in the "margin-less printing", the process goes to step S802. In step S802, a check is made to see if the measured values (Dcount(i)=1, N) of 64 nozzle counters included in area A for all the colors reach the threshold value (TH). That is, if all of the measured values of the nozzle counters included in area A satisfy Dcount≧3, the process goes to step S803 to reset the printable time (PENBL) for initialization. If the measured value of any one of the nozzle counters satisfies Dcount<3, the process goes to step S804 to subtract 50 msec from the printable time (PENBL) to update the printable time (PENBL).

When setting of the printable time (PENBL) is completed by steps S803 to S807, the process goes to step S808 to initialize all of the measured values (Dcount(i); i=1 to N) of the nozzle counters to "0". This is the end of the interrupt processing.

The interrupt processing described in FIG. 8, if the timer is already started by step S305 in FIG. 7, is executed every 50 msec even during processing of a subsequent step S306 and following steps.

Now, going back again to the flow chart of FIG. 7, when a printing operation is started in step S306, the printing head 31 is moved to perform printing scanning in step S307. The printing apparatus in the present embodiment performs so-called bidirectional printing, in which printing is performed by discharging ink in both forward and backward scanning directions of the carriage. Thus, in each printing scanning, the carriage is first accelerated to a predetermined speed and ink is discharged on the printing medium during movement at a constant speed of the predetermined speed. And then, the carriage is decelerated and the direction of the movement is reversed. This process is carried out as one printing scanning.

In the present embodiment, however, processing of step S308 is simultaneously performed immediately before the carriage 2 is decelerated. In step S308, a judgment is made whether or not all printing tasks within a page are completed in current printing scanning. If it is judged that they are completed, this processing will be terminated. If it is judged that image data to be printed still exits, the process goes to step S309.

In step S309, a current printable time (PENBL) is compared with a time (Tscan) required for a next printing scanning. If PENBL is equal to or greater than Tscan, the next printing scanning is deemed to be possible without any preliminary discharge operation and the process returns to step S307. On the other hand, if PENBL is smaller than Tscan, a preliminary discharge operation is judged to be necessary before the next printing scanning and the process goes to step S310.

In step S310, the preliminary discharge operation of the printing head 31 is performed. In the present embodiment, a preliminary discharge position is a capping position as the home position. The preliminary discharge may be performed on all the nozzles for all the colors, but if the next printing scanning is provided to the front or rear edge in the "margin-less printing", the preliminary discharge may be performed on only the nozzles included in area A.

In a subsequent step S311, the printable time (PENBL) is reset to the initial value.

Further, in step S312, all of the measured values (Dcount (i); i=1 to N) of the nozzle counters are reset to "0". Thereafter, the process returns to step S307 for the next printing scanning.

Incidentally, even after this processing has been completed as a result of the judgment in step S308, if a next printing command is inputted in a relatively short time, the process can be started with step S307. However, if no printing command is inputted in a predetermined time, the printing head 31 is moved to the home position and capped by the capping mechanism 11.

As described above, according to the present embodiment, even when the time (Tscan) required for a next printing scanning is compared with the printable time (PENBL) for which printing is possible without any preliminary discharge with each completion of printing scanning in accordance with the conventional preliminary discharge method, nozzles in an area where discharge is not performed in the next printing scanning are excluded from judgment on the printable time (PENBL). That is, even in such a situation where printing is being performed on the front or rear edge in the "margin-less printing", there is no chance that the preliminary discharge is improperly performed for nozzles not used for the printing. Consequently, the decrease in the throughput and the amount of ink consumption associated with the preliminary discharge can be minimized.

Second Embodiment

In the above-mentioned embodiment, a printing mode, "margin-less printing", has been described, but the present invention is not applicable only to the printing mode, "margin-less printing". It is broadly applicable to a printing mode in which printing scanning is performed using only a part of a plurality of nozzles provided in the printing head. Hereinafter, application to a normal printing mode, not "margin-less printing", will be described.

As described above, the printing medium is conveyed by two pairs of rollers. One of the two pairs of rollers is a pair of rollers located upstream of the printing head, specifically, a pair of rollers consisting of the conveying roller 14 and the pinch roller 15. The other is a pair of rollers located downstream of the printing head, specifically, a pair of rollers consisting of the discharging roller 20 and the spur roller.

When printing is performed on a central part, not the front and rear portions of the printing medium, the printing medium is retained and conveyed by these two pairs of rollers. Therefore, the conveyance accuracy of the printing medium is high. When printing is performed on the front and rear portions of the printing medium, however, the printing medium is retained and conveyed by only one of these two pairs of rollers. Hence, the conveyance accuracy of the printing medium is low.

In this case, as described in the Japanese Patent Application Laid-open No. 2002-137371, when printing is performed on the front and rear portions of the printing medium, it is useful to reduce the number of nozzles used and the amount of each conveyance, compared to when the printing is performed on the central part. According to this approach, the printing medium can be conveyed with a relatively high accuracy at the front and rear portions.

Incidentally, in accordance with the above-mentioned approach, even in the normal printing mode, not the "margin-less printing", when printing is performed on the front and rear portions, the range of use of the nozzles is limited, compared to when the printing is performed on the central part. Then, as with the "margin-less printing" in the first embodiment, when printing is performed on the front and rear portions, only the nozzles in the limited range of use (area of use) are used as objects of judgment on the printable time (PENBL). Specifically, as described in FIG. 7 and FIG. 8, the current printable time (PENBL) is compared with the time (Tscan) required for a next printing scanning only for nozzles to be used. And, if PENBL is equal to or greater than Tscan, it is judged that the next printing scanning can be performed without any preliminary discharge operation, and the next printing scanning is performed without any preliminary discharge operation. On the other hand, if PENBL is smaller than Tscan, it is judged that the preliminary discharge operation is necessary before the next printing scanning is performed, and the preliminary discharge is performed before the next printing scanning.

According to the foregoing arrangement, even in the normal printing mode, not the "margin-less printing", the nozzles in the area (range) where the discharge is not performed in the next printing scanning can be excluded from judgment on the printable time (PENBL). Accordingly, an improper preliminary discharge can be prevented.

Other Embodiments

In addition, the foregoing first and second embodiments are arranged to compare the printable time (PENBL) with the time required for the next printing scanning (Tscan), but the present invention is not limited thereto. For a printing apparatus capable of setting the initial value of PENBL to a greater value in advance, another unit, for example, a plurality of printing scanning units may be set up and both may be compared to perform the preliminary discharge.

Further, in the foregoing description, the flow chart (FIG. 7) based on the preliminary discharge sequence described in the Japanese Patent Application Laid-open No. 2004-082629, is used, but the present invention is not limited to such process. Instead of adjusting the printable time (PENBL) at the predetermined timing as in the above-mentioned Publication, for example, the arrangement as described in the Japanese Patent Application Laid-open No. 63-252748 is also acceptable. If any printing apparatus has a device for counting the number of discharges on a nozzle-by-nozzle basis and also includes a mechanism for determining whether or not the preliminary discharge is performed by the use of the count value, the present invention can effectively function.

Furthermore, in the foregoing first and second embodiments, descriptions have been made using the arrangement wherein the preliminary discharge operation is performed toward the capping mechanism 11 in the home position, but the present invention is not limited thereto. Among recent ink jet printing apparatuses, there are many types of printing apparatus that have a preliminary discharge pad for receiving the preliminary discharge pre-mounted in a closer position than the capping mechanism 11 on both sides of the printing area in the carriage scanning direction. With such arrangement, even when the preliminary discharge is needed during printing operation, the carriage 2 does not have to be moved to the capping mechanism 11 every time. Since the preliminary discharge operation can be performed on the preliminary discharge pad located in a closer position, it is possible to perform the preliminary discharge operation more efficiently in terms of the throughput.

Besides, in the foregoing first and second embodiments, there has been described a form in which the range of the nozzles to be used is limited for the front-portion or rear-portion printing in the "margin-less printing" or "normal printing", but the present invention is not limited to this form. Any ink jet printing apparatus that has a mechanism capable of preliminarily detecting that printing scanning is performed by nozzles included in a part of the nozzle area provided in the printing head can achieve the advantageous effect of the present invention. That is, as shown in the flow chart of FIG. 8, providing a process and device for judging whether or not a next printing operation is to be performed only by a predetermined part of the nozzles avoids decreasing the throughput and consuming more ink than necessary because of the preliminary discharge operation.

Moreover, in the foregoing embodiments, the ink jet printing apparatus arranged to discharge the ink from the nozzles by the use of thermal energy has been described as an example, but the present invention is not limited thereto. A printing apparatus arranged to discharge ink from nozzles by the use of mechanical vibrations of piezo elements or the like is, of course, applicable. Thus, any ink jet printing apparatus that prints an image by the use of the printing head provided with a plurality of nozzles capable of discharging ink can completely achieve the advantageous effect of the present invention.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

This application claims priority from Japanese Patent Application No. 2005-198953 filed Jul. 7, 2005, which is hereby incorporated by reference herein.

What is claimed is:

1. An ink jet printing apparatus capable of printing an image on a printing medium using a printing head having a plurality of printing elements for discharging ink, comprising:

counting means for counting the number of ink discharges by the printing head;

judging means for judging whether or not a preliminary discharge operation by the printing head is necessary, based on the number counted by the counting means; and means for causing the printing head to perform the preliminary discharge operation in accordance with a result of the judgment by the judging means, wherein when a printing operation is performed by usable printing elements corresponding to a portion of the plurality of printing elements, the judging means judges whether or not the preliminary discharge operation is necessary based on the number counted for the portion of the plurality of printing elements.

2. An ink jet printing apparatus capable of printing an image on a printing medium using a printing head having a plurality of printing elements for discharging ink, comprising:

print control means for performing a first printing operation in which printing can be performed on a central part of the printing medium using the plurality of printing elements and a second printing operation in which printing can be performed on front and rear portions of the printing medium using a portion of the plurality of printing elements;

counting means for counting the number of ink discharges by the printing head;

judging means for judging whether or not a preliminary discharge operation by the printing head is necessary, based on the number counted by the counting means; and means for causing the printing head to perform the preliminary discharge operation in accordance with a result of the judgment by the judging means, wherein when the second printing operation is performed, the judging means judges whether or not the preliminary discharge operation is necessary based on the number counted for the portion of the printing elements, and when the first printing operation is performed, the judging means judges whether or not the preliminary discharge operation is necessary based on the number counted for the plurality of the printing elements.

3. An ink jet printing apparatus capable of printing an image on a printing medium using a printing head including a plurality of printing elements to discharge ink, comprising:

determining means for determining whether or not only a portion of the plurality of printing elements are usable for a printing operation;

counting means for counting the number of ink discharges by the printing elements for the printing operation;

judging means for judging whether or not a preliminary discharge operation by the printing head is necessary based on the number counted by the counting means; and means for causing the printing head to perform the preliminary discharge operation in accordance with a result of the judgment by the judging means, wherein if the determining means determines that only the portion of the plurality of printing elements are usable, the judging means judges whether or not the preliminary discharge operation is necessary based on the number counted for the portion of the printing elements, and if the determining means does not determine that only the portion of the plurality of printing elements are usable, the judging means judges whether or not the preliminary discharge operation is necessary based on the number counted for the plurality of printing elements.

4. The apparatus according to claim 3, wherein the judging means compares the number counted by the counting means with a threshold value at predetermined time intervals to judge whether or not the preliminary discharge operation is necessary.

5. The apparatus according to claim 3, further comprising:

means for performing a main scan for causing the printing head to scan the printing medium in order to perform the printing operation, wherein the judging means compares the number counted by the counting means with a threshold value at a predetermined timing to set a printable time from the predetermined timing, and further compares the printable time with a time required for the main scan to judge whether or not the preliminary discharge operation is necessary.

6. The apparatus according to claim 5, wherein if the printable time is shorter than the time required for the main scan, the preliminary discharge operation is performed before a next main scan.

7. An ink jet printing method capable of printing an image on a printing medium using a printing head including a plurality of printing elements for discharging ink, comprising the steps of:

counting the number of ink discharges by the printing head;

judging whether or not a preliminary discharge operation by the printing head is necessary, based on the number counted by the counting step; and causing the printing head to perform the preliminary discharge operation in accordance with a result of the judgment, wherein when a printing operation is performed by usable printing elements corresponding to a portion of the plurality of printing elements, in the judging step, whether or not the preliminary discharge operation is necessary is judged based on the number counted for the portion of the plurality of printing elements.

8. An ink jet printing method capable of printing an image on a printing medium using a printing head having a plurality of printing elements for discharging ink, comprising:

a first printing step of performing printing on a central part of the printing medium using the plurality of printing elements;

a second printing step of performing printing on front and rear portions of the printing medium using a portion of the plurality of printing elements;

a counting step of counting the number of ink discharges by the printing head;

a judging step of judging whether or not a preliminary discharge operation by the printing head is necessary, based on the number counted by the counting step; and a step of causing the printing head to perform the preliminary discharge operation in accordance with a result of the judgment, wherein, for the second printing step, whether or not the preliminary discharge operation is necessary is judged based on the number counted for the portion of the printing elements in the judging step, and for the first printing step, whether or not the preliminary discharge operation is necessary is judged based on the number counted for the plurality of the printing elements in the judging step.

9. A preliminary discharge control method for an ink jet printing apparatus capable of printing an image on a printing medium using a printing head having a plurality of printing elements to discharge ink, comprising the steps of:

determining whether or not only a portion of the plurality of printing elements are usable for a printing operation;

counting the number of ink discharges from each of the printing elements for the printing operation;

judging whether or not a preliminary discharge operation by the printing head is necessary based on the number counted by the counting step; and causing the printing head to perform the preliminary discharge operation in accordance with a result of the judgment by the judging step, wherein if it is determined that only the portion of the plurality of printing elements are usable in the determining step, whether or not the preliminary discharge operation is necessary is judged based on the number counted for the portion of the printing elements in the judging step, and if it is not determined that only the portion of the plurality of printing elements are usable in the determining step, whether or not the preliminary discharge operation is necessary is judged based on the number counted for the plurality of printing elements in the judging step.

* * * * *